US005081178A

United States Patent [19]

Angel et al.

[11] Patent Number: 5,081,178

[45] Date of Patent: Jan. 14, 1992

[54] AQUEOUS SYNTHETIC RESIN DISPERSIONS

[75] Inventors: Maximilian Angel, Mutterstadt; Andreas Einwiller, Mannheim, both of Fed. Rep. of Germany

[73] Assignee: BASF Aktiengesellschaft, Ludwigshafen, Fed. Rep. of Germany

[21] Appl. No.: 503,925

[22] Filed: Apr. 4, 1990

[30] Foreign Application Priority Data

Apr. 12, 1989 [DE] Fed. Rep. of Germany ..... 3911942

[51] Int. Cl.[5] ..... C08L 33/24

[52] U.S. Cl. ..... 524/521; 524/812; 524/813; 524/555

[58] Field of Search ..... 524/812, 813, 457, 555, 524/521

[56] References Cited

U.S. PATENT DOCUMENTS 4,289,676 9/1981 Czauderna et al. ..... 526/304

FOREIGN PATENT DOCUMENTS 0019169 5/1980 European Pat. Off. .
281083 9/1988 European Pat. Off. .

OTHER PUBLICATIONS

Journal of Polymer Science: Polymer Letters Edition, vol. 17, pp. 369-378 (1979).

*Primary Examiner*—Joseph L. Schofer
*Assistant Examiner*—Jeffrey T. Smith
*Attorney, Agent, or Firm*—Oblon, Spivak, McClelland, Maier & Neustadt

[57] ABSTRACT

Aqueous synthetic resin dispersions are obtainable by combining an aqueous starting dispersion of a polymer A, which has a glass transition temperature of from −50° to +60° C. and is composed of monoethtylenically unsaturated monomers which, apart from carboxyl groups and their derivatives, carry no further groups which are polymerizable or condensable with one another, with or without butadiene, and an aqueous solution of a polymer B, which is essentially composed of N-hydroxycarboxymethylamides of acrylic and/or methacrylic acid and/or water-soluble salts of these N-hydroxycarboxymethylamides, at the beginning, in the course of, and/or after completion of, the preparation of the aqueous starting dispersion, with the proviso that the solids content of polymer B is from 0.5 to 10% by weight, based on the total amount of polymer A and polymer B.

7 Claims, No Drawings

AQUEOUS SYNTHETIC RESIN DISPERSIONS

The present invention relates to aqueous synthetic resin dispersions obtainable by combining an aqueous starting dispersion of a polymer A, which has a glass transition temperature of from −50 to +60° C. and is composed of monoethylenically unsaturated monomers which, apart from carboxyl groups and their derivatives, carry no further groups which are polymerizable or condensable with one another, with or without butadiene, and an aqueous solution of a polymer B, which is essentially composed of N-hydroxycarboxymethylamides of acrylic and/or methacrylic acid and/or water-soluble salts of these N-hydroxycarboxymethylamides, at the beginning, in the course of, and/or after completion of, the preparation of the aqueous starting dispersion, with the proviso that the solids content of polymer B is from 0.5 to 10% by weight, based on the total amount of polymer A and polymer B.

The present invention furthermore relates to the use of these synthetic resin dispersions as binders in the production of nonwovens from fiber webs.

Nonwovens are all sheet-like textile structures which are produced by consolidating loose accumulations of individual fibers (fiber webs). Consolidation of fiber webs by impregnation or coating with aqueous synthetic resin dispersions and subsequent evaporation of the water is generally known. EP-A 19169 relates to aqueous dispersions of copolymers which contain repeating units of the general formula I

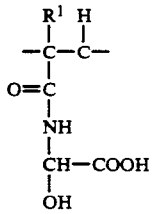

I where $R^1$ is hydrogen or methyl, and are composed of not less than 85% by weight of acrylates and/or methacrylates of alkanols of 1 to 8 carbon atoms and/or vinyl esters of acetic or propionic acid and/or vinyl chloride, where up to 40% by weight of the stated monomers may be replaced by acrylonitrile, styrene or butadiene, and from 0 to 5% by weight of $\alpha,\beta$-monoolefinically unsaturated mono-and/or dicarboxylic acids of 3 to 5 carbon atoms and/or their amides. These dispersions are recommended as binders for the production of nonwovens from fiber webs, in order to obtain nonwovens which on the one hand are resistant to washing and cleaning and on the other hand do not release any formaldehyde during their processing and use. However, the performance characteristics of the dispersions disclosed by way of example are unsatisfactory, since mats consolidated with these dispersions give nonwovens which do not have heat-sealing properties. However, the combination of heat-sealing properties and resistance to washing and cleaning is important, especially when the nonwovens are used in the hygiene sector, where a laminate of nonwoven hygiene fabrics with themselves or with other substrates, without the use of additional adhesives, is often required.

Earlier. application P 37 34 752.7 relates to aqueous dispersions of copolymers which are composed of from 85 to 99.5% by weight of $\alpha,\beta$-monoolefinically unsaturated carboxylates of 3 to 12 carbon atoms, from 0.5 to 10% by weight of monomers of the general formula II

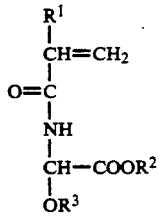

II where $R^2$ and $R^3$ independently of one another and independently of $R^1$ have the same meanings as $R^1$, and from 0 to 5% by weight of $\alpha\beta$-monoethylenically unsaturated mono- and/or dicarboxylic acids of 3 to 5 carbon atoms and/or their amides, where up to 35% by weight of the incorporated $\alpha,\beta$-monoolefinically unsaturated carboxylates may be vinyl monocarboxylates. These dispersions are recommended as binders for the production of nonwovens from fiber webs, in order to obtain nonwovens which are resistant to washing and cleaning, do not release any formaldehyde during their processing and use and also have heat-sealing properties. However, the disadvantage of these dispersions is that they have to be prepared by a complex emulsion polymerization process with two stages involving different monomer compositions.

EP-A 281 083 discloses aqueous synthetic resin dispersions whose films have high blocking resistance and which likewise are suitable as binders in nonwovens. The associated copolymers contain essentially vinyl acetate, 1 to 20% by weight of ethylene, from 0.5 to 15% by weight, based on vinyl acetate, of acrylamidoglycollic acid or related compounds and from 0.1 to 5% by weight of an acrylamide.

It is an object of the present invention to provide synthetic resin dispersions which are obtainable in a simple manner and are particularly suitable for consolidating mats, the nonwovens obtained being resistant to washing and cleaning, releasing no formaldehyde during their processing and furthermore having satisfactory heat-sealing properties.

We have found that this object is achieved by the aqueous synthetic resin dispersions defined at the outset Preferred building blocks of polymer A, in addition to butadiene, are ethylene, $\alpha,\beta$-monoethylenically unsaturated mono- and dicarboxylic acids of 3 to 5 carbon atoms and their unsubstituted amides, particularly preferably acrylic and methacrylic acid, as well as maleic and itaconic acid and the mono- and diamides derived from these carboxylic acids, esters of $\alpha,\beta$-monoethylenically unsaturated monocarboxylic acids of 2 to 5 carbon atoms and alkanols of 1 to 8 carbon atoms, in particular the esters of acrylic and of methacrylic acid, of which the acrylates are preferred, vinyl esters of aliphatic monocarboxylic acids of up to 6 carbon atoms, acrylonitrile and methacrylonitrile, vinylaromatic monomers, such as styrene, vinyltoluenes, chlorostyrenes or tert-butylstyrenes, and vinyl halides, such as vinyl chloride and vinylidene chloride. Particularly preferred acrylates are methyl acrylate, ethyl acrylate, isopropyl acrylate, n-butyl acrylate, isobutyl acrylate and 2-ethylhexyl acrylate, while preferred esters of methacrylic acid are n-butyl methacrylate, isobutyl methacrylate and 2-ethylhexyl methacrylate. Preferred vinyl esters are vinyl acetate and vinyl propionate, while styrene is preferred among the vinylaromatic monomers.

In general, the weights of the monomers used in the synthesis of polymer A are chosen with the aid of the Fox relationship, in such a way that polymer A has a glass transition temperature of from −50° to +60° C., preferably from −50° to −5° C. According to Fox (T.G. Fox, Bull. Am. Phys. Soc. (Ser. II) 1 (1956), 123, the following is a good approximation for the glass transition temperature of copolymers:

$$\frac{1}{Tg} = \frac{X^1}{Tg^1} + \frac{X^2}{Tg^2} + \ldots \frac{X^n}{Tg^n}$$

where $X^1, X^2, \ldots X^n$ are the mass fractions of the monomers 1, 2, . . . , n and $Tg^1, Tg^2, \ldots, Tg^n$ are the glass transition temperatures, in degrees Kelvin, of the polymers composed of only one of the monomers 1, 2, . . . or n. The glass transition temperatures of these homopolymers of the abovementioned monomers are known and are described in, for example, J. Brandrup and E.H. Immergut, Polymer Handbook 1st Ed., J. Wiley, New York 1966 and 2nd Ed., J. Wiley, New York 1975.

The aqueous starting dispersions containing the polymers A are advantageously prepared by single-stage polymerization of the particular monomers in an aqueous medium under the known conditions of emulsion polymerization in the presence of water-soluble free-radical initiators and emulsifiers and in the presence or absence of protective colloids and regulators and further assistants. Particularly suitable water-soluble polymerization initiators are peroxides, such as sodium peroxydisulfate or hydrogen peroxide, and combined systems which contain an organic reducing agent, a peroxide and a small amount of a metal compound which is soluble in the polymerization medium and whose metallic component may occur in a plurality of valence states, for example ascorbic acid/iron(II) sulfate/hydrogen peroxide.

Ethoxylated alkylphenols (degree of ethoxylation: from 3 to 30, $C_8$-$C_{10}$-alkyl radicals), the alkali metal salts of their sulfated derivatives, the alkali metal salts of alkylsulfonic acids, such as sodium n-dodecylsulfonate or sodium n-tetradecylsulfonate, and the alkali metal salts of alkylarylsulfonic acids, such as sodium n-dodecylbenzenesulfonate or sodium n-tetradecylbenzenesulfonate, have proven particularly suitable emulsifiers. The emulsion polymerization temperature is usually from 0° to 100° C., preferably from 20° to 90° C.

The emulsion polymerization can be carried out as a batch process or feed process. The feed process, in which some of the polymerization mixture is initially taken and heated to the polymerization temperature and the remainder is then fed in continuously in separate feeds, one of which contains the monomers in pure or emulsified form, is preferred. The monomers are preferably fed in as an aqueous emulsion The number average molecular weight $M_n$ of the dispersed polymer is in general from $5\times10^3$ to $5\times10^6$, preferably form $10^5$ to $2\times10^6$. Advantageously, the starting dispersions prepared have a solids content of from 35 to 65% by weight.

The preparation of the aqueous solutions of the polymers B is usually carried out by free-radical polymerization in aqueous solution and is described in, inter alia, J. Polym:. Sci., Polym. Lett. Ed. 17 (1979), 369–378. As a rule, the substances which are also suitable for the preparation of the starting dispersion (A) can be used as water soluble polymerization initiators. They are usually used in amounts of from 0.1 to 3% by weight, based on the monomers Polymerization is advantageously carried out in the presence of small amounts of emulsifiers (not more than 10% by weight, based on the monomers), the emulsifiers used preferably being the same as those employed for the preparation of the starting dispersion (A). The polymerization temperature is usually from 45° to 95° C., preferably from 60° to 85° C. The polymerization can be carried out as a batch process or feed process. The feed process is preferred, in a particularly preferred procedure an aqueous solution containing the monomers and, as the first part of a combined initiator system, hydrogen peroxide being initially taken and heated to the polymerization temperature, and the second part of the combined initiator system then being fed in continuously, while maintaining the polymerization temperature, in the course of a few hours, with an aqueous solution containing the organic reducing agent and the soluble metal compound, and polymerization then being continued for a further 1–2 hours. The weight average molecular weight $M_w$ is usually from $10^5$ to $10^6$.

Since the N-hydroxycarboxymethylamides of acrylic and/or methacrylic acid are only moderately water-soluble, their alkali metal or ammonium salts, which are more readily soluble in water, in particular their sodium and potassium salts, are preferably used for the preparation of aqueous solutions of the polymers B. The polymerization is particularly preferably carried out in aqueous solutions which contain mixtures of free acids and their corresponding alkali metal or ammonium salts and preferably have a pH of from 2 to 7, particularly preferably from 2 to 4. The activity of the polymers B is not substantially adversely affected if they additionally contain up to 20% by weight of water-soluble monomers, such as acrylic acid, methacrylic acid or their amides, as copolymerized units.

The novel aqueous synthetic resin dispersions are preferably obtainable by a procedure in which an aqueous solution of a polymer B is stirred into a starting dispersion (A) at the beginning, in the course of, and/or after completion of, the preparation of said dispersion, preferably into a ready..prepared starting dispersion, and the amounts to be used are such that the solids content of polymer B is from 0.5 to 10, preferably from 2 to 5%,by weight, based on the total amount of polymer A and polymer B. It is particularly advantageous if combination of a starting dispersion A and an aqueous solution of a polymer B for the preparation of a certain novel synthetic resin dispersion can be effected either by the manufacturer or by the end user. The novel synthetic resin dispersions are particularly suitable as binders for the production of nonwovens from fiber webs, to which they impart heat-sealing properties and resistance to washing and cleaning, ie. in particular high wet strength, and a soft hand. When used for binding fiber webs, novel synthetic resin dispersions having a total solids content of from 10 to 30% by weight are preferably used. The assistants used may include external plasticizers, inert fillers, thickeners, colorants, agents for increasing the aging resistance of flameproofing agents, in conventional amounts. The novel synthetic resin dispersions are suitable for consolidating both webs of natural fibers, such as vegetable, animal or mineral fibers, and webs of manmade fibers, and the webs may be needle-punched, rolled, shrunk and/or reinforced with yarns. Examples are fibers of cotton, wool, polyamides, polyesters, polyolefins, synthetic cellulose (viscose), rockwool or asbestos fibers. The novel synthetic resin dispersions are also suitable for impregnating and coating sheet-like textile structures which are woven and/or have a mesh structure, and as binders for textile print pastes, paper coat slips, coating materials or leather-protecting films, as coating agents for films and as finishing agents for textiles.

When used as binders for fiber webs, the novel synthetic resin dispersions can be applied in a conventional manner, for example by impregnation, spraying, coating or printing. As a rule, the excess binder is then separated off, for example by squeezing between two rollers running in opposite directions, and the binder-containing mat is dried and is then heated for a few minutes, temperatures of from 110° to 200° C., preferably from 120° to 170° C., generally being used. The binder content of the nonwoven is usually from 20 to 60, preferably from 20 to 35, % by weight (based on anhydrous material).

Examples

EXAMPLE 1

Preparation of an aqueous polyacrylamidoglycollic acid solution B1

A solution of 150 g of acrylamidoglycollic acid, 1.5 g of a 40% strength by weight aqueous solution of a mixture of equal parts of Na n-dodecylsulfonate, Na n-tetradecylsulfonate and 1 g of a 30% strength by weight aqueous hydrogen peroxide solution in 1,248 g of water was heated to the polymerization temperature of 80° C. and a solution of 0.3 g of ascorbic acid and 0.001 g of iron(II) sulfate in 100 g of water was added continuously in the course of 2 hours while maintaining this temperature. Polymerization was then continued for a further hour at 80° C.

The solids content of the resulting low-viscosity aqueous solution wa 10% by weight.

EXAMPLES 2 AND 3

Preparation of the novel synthetic resin dispersions B2 and B3

B2

350 g of solution B1 was stirred into 2,000 g of a 50% strength by weight aqueous starting dispersion of pure polyethyl acrylate, which dispersion had been prepared by a single-stage emulsion polymerization. A stable synthetic resin dispersion having a solids content of 44% by weight was obtained.

B3

250 g of solution B1 was stirred into 2,000 g of a 50% strength by weight aqueous starting dispersion of a copolymer of 52.5% by weight of ethyl acrylate, 31.5% by weight of methyl acrylate, 10% by weight of styrene and 6% by weight of n-butyl acrylate, which dispersion had been prepared by single-stage emulsion polymerization. A stable synthetic resin dispersion having a solids content of 45% by weight was obtained.

EXAMPLE 4

Investigation of various bonded webs

A) A longitudinally laid (fiber orientation preferentially in one direction, the longitudinal direction) web of polyester fibers having a length of 40 mm and a mean denier of 1.7 dtex (1 dtex corresponds to a fiber mass of $1\times10^{-4}$ g for a fiber length of 1 m) was impregnated, in independent experiments, with the synthetic resin dispersions B2 and B3, which had been diluted beforehand to a uniform solids content of 20% by weight, and was passed between two rollers running in opposite directions, in order to separate off the excess dispersion, and was then heated at 150° C. for 4 minutes. The binder content of the resulting nonwovens was 33% by weight in all cases, for a final weight per unit area of 50 g/m$^2$. Thereafter, 50 mm wide strips of these nonwovens, having a free clamping length of 10 cm, were subjected to a strip tensile test after being moistened by water and after heat-sealing (heat-sealing conditions: 2 sec, 170° C., 6 bar, sealing area 5 cm$^2$, lower surface of one strip sealed against upper surface of another strip), similarly to DIN 53,857, to determine the maximum tensile strength (parallel to the preferential fiber direction). The results are shown in Table 1. Table 1 also contains the result of a Comparative Experiment V, in which, instead of the novel synthetic resin dispersions, a 20% strength by weight synthetic resin dispersion obtained by diluting a dispersion according to Preparation Example 4 from European Patent 19169 was used.

TABLE 1

| | Maximum tensile force [N] | |
|---|---|---|
| | Moistened with water | After sealing |
| B2 | 33 | 19.3 |
| B3 | 47 | 15.0 |
| V | 55 | 0 |

B) As for A), except that the web consisted of vicose fibers having a length of 40 mm and a mean denier of 3.3 dtex. The results are shown in Table 2.

TABLE 2

| | Maximum tensile force [N] | |
|---|---|---|
| | Moistened with water | After sealing |
| B2 | 37 | 8.8 |
| B3 | 38 | 11.6 |
| V | 39 | 0 |

We claim:

1. An aqueous synthetic resin dispersion, comprising an aqueous dispersion of a polymer A which has a glass transition temperature of from −50 to +60° C. and is composed of monoethylenically unsaturated monomers which, apart from carboxyl groups and their derivatives, carry no further groups which are polymerizable or condensible with one another; and an aqueous solution of polymer B, which is essentially composed of one or more compounds selected from the group consisting of the N-hydroxycarboxymethylamide of acrylic acid, and the N-hydroxycarboxymethylamie of methacrylic acid and water soluble salts of these amides, with the proviso that the solid content of polymer b is from 0.5 to 10% by weight, based on the total amount of polymer A and polymer B, wherein aid polymer A is composed of monoethylenically unsaturated monomers selected from the group consisting of butadiene, ehtylene, alpha-beta monoethylenically unsaturated mono- and dicarboxylic acids of 3 to 5 carbon atoms and their unsubstituted amides, esters of alpha-beta monoethylenically unsaturated monocarboxylic acids of 2 to 5 carbon atoms, vinyl esters of aliphatic monocarboxylic acids up to 6 carbon atoms, acrylonitrile, methacrylonitrile, styrene, vinyl toluenes, chlorostyrenes, tertiary-butyl styrenes and vinyl halides.

2. The aqueous dispersion of claim 1, wherein said polymer A is selected from the group consisting of methylacrylate, ethylacrylate, isopropyl acrylate, n-butyl acrylate, isobutyl acrylate, 2-ethylhexyl acrylate, n-butyl methacrylate, isobutyl methacrylate, 2- ethylhexyl methacrylate, vinyl acetate, vinyl propionate and styrene.

3. A binder, comprising the aqueous synthetic resin dispersion of claim 1, which binder produces nonwovens from fiber webs.

4. An aqueous synthetic resin dispersion, comprising an aqueous dispersion of a polymer A which has a glass transition temperature of from −50° to +60° C. and is composed of monoethylenically unsaturated monomers which, apart from carboxyl groups and their derivatives, carry no further groups which are polymerizable or condensible with one another, and of butadiene; and an aqueous solution of polymer B, which is essentially composed of one or more compounds selected from the group consisting of the N-hydroxycarboxymethylamide of acrylic acid, and the N-hydroxycarboxymethylamide of methacrylic acid and water soluble salts of these amides, with the proviso that the solid content of polymer B is from 0.5 to 10% by weight, based on the total amount of polymer A and polymer B, wherein said polymer A is composed of monoethylenically unsaturated monomers selected from the group consisting of ethylene, alpha-beta monoethylenically unsaturated mono- and dicarboxylic acids of 3 to 5 carbon atoms and their unsubstituted amides, esters of alpha-beta monoethylenically unsaturated monocarboxylic acids of 2 to 5 carbon atoms, vinyl esters of aliphatic monocarboxylic acids up to 6 carbon atoms, acrylonitrile, methacrylonitrile, styrene, vinyl toluenes, chlorostyrenes, tertiary-butyl styrenes and vinyl halides.

5. A binder, comprising the aqueous synthetic resin dispersion of claim 4, which binder produces nonwovens from fiber webs.

6. A process for the preparation of the aqueous synthetic resin dispersion as claimed in claim 1, wherein the aqueous solution of polymer B is added at the beginning or during the course of, or after completion of, or throughout the preparation of the dispersion of polymer A, with the proviso that the solids content of polymer B is from 0.5 to 10% by weight, based on the total amount of polymer A and polymer B.

7. A process for the preparation of the aqueous synthetic resin dispersion as claimed in claim 4, wherein the aqueous solution of polymer B is added at the beginning, or during the course of, or after completion of, or throughout the preparation of the dispersion of polymer A, with the proviso that the solids content of polymer B is from 0.5 to 10% by weight, based on the total amount of polymer A and polymer B.

* * * * *